US009955812B2

(12) United States Patent
Charbeneau

(10) Patent No.: US 9,955,812 B2
(45) Date of Patent: May 1, 2018

(54) PARCEL RECEIVING APPARATUS AND ASSOCIATED METHODS

(71) Applicant: Michael Patrick Charbeneau, Encino, CA (US)

(72) Inventor: Michael Patrick Charbeneau, Encino, CA (US)

(73) Assignee: Michael Patrick Charbeneau, Stamford, CT (US)

( * ) Notice: Subject to any disclaimer, the term of this patent is extended or adjusted under 35 U.S.C. 154(b) by 0 days. days.

(21) Appl. No.: 15/360,493

(22) Filed: Nov. 23, 2016

(65) Prior Publication Data

US 2017/0143146 A1 May 25, 2017

Related U.S. Application Data

(60) Provisional application No. 62/259,737, filed on Nov. 25, 2015.

(51) Int. Cl.
*G06K 5/00* (2006.01)
*A47G 29/14* (2006.01)

(52) U.S. Cl.
CPC ..... *A47G 29/141* (2013.01)

(58) Field of Classification Search
CPC . G06K 5/00; G06K 7/01; G06K 19/00; G06F 17/00
USPC ..... 235/382, 375, 382.5, 487
See application file for complete search history.

(56) References Cited

U.S. PATENT DOCUMENTS 6,722,561 B1 * 4/2004 Thomas ..... A47G 29/1209 232/27
2002/0023949 A1 * 2/2002 Tucker ..... A47G 29/141 232/45
2010/0127063 A1 * 5/2010 Bolles ..... A47G 29/22 232/39
2015/0199857 A1 * 7/2015 Mackin ..... G07C 9/00023 340/5.26
2016/0000249 A1 * 1/2016 Matthews ..... E05C 19/18 70/14
2016/0331171 A1 * 11/2016 Jiang ..... G06Q 10/0833

* cited by examiner

*Primary Examiner* — Edwyn Labaze
(74) *Attorney, Agent, or Firm* — Mark Malek; Stephen Bullock Widerman Malek, PL

(57) ABSTRACT

Embodiments of the present invention are related to a parcel receiving apparatus that may comprise a parcel bin, a frame assembly, and a locking system. The frame assembly may be configured to fit inside a support structure aperture and circumscribe the parcel bin. Additionally, the parcel bin may be rotatably attached to the frame assembly along a fixed axis. The locking system may be operable to permit or deny a user from rotating the parcel bin into an open position. Applications of the parcel receiving apparatus may include remote access and automatic rotating functionality.

19 Claims, 7 Drawing Sheets

PARCEL RECEIVING APPARATUS AND ASSOCIATED METHODS

RELATED APPLICATIONS

This patent application claims the benefit under 35 U.S.C. § 119(e) of U.S. Provisional Patent Application Ser. No. 62/259,737, titled Parcel Receiving Apparatus and Associated Methods, and filed on. Nov. 25, 2015, the entire contents of which are incorporated herein by reference, except to the extent that the contents therein conflict with the contents herein.

FIELD OF THE INVENTION

The present invention relates to systems and methods for a parcel receiving apparatus.

BACKGROUND

Apparatuses for receiving packages without involving a person at the receiving location are known in the art. However, previous solutions have typically had substantial hardware requirements and expensive componentry and featured minimal security, relying on traditional methods of physical keys or combination dial locks. There is a need in the art for a package receiving solution that is versatile in terms of where it can be installed, the cost associated with such installation, and an increased level of security over present solutions. Moreover, as automation technology progresses, there is a need in the art for a package receiving solution that facilitates automated delivery of packages.

This background information is provided to reveal information believed by the applicant to be of possible relevance to the present invention. No admission is necessarily intended, nor should be construed, that any of the preceding information constitutes prior art against the present invention.

SUMMARY OF THE INVENTION

With the above in mind, embodiments of the present invention are related to a parcel receiving apparatus that may comprise a parcel bin, a frame assembly, and a locking system. The frame assembly may be configured to fit inside a support structure aperture and circumscribe the parcel bin. Additionally, the parcel bin may be rotatably attached to the frame assembly along a fixed axis. The locking system may be operable to permit or deny a user from rotating the parcel bin into an open position.

In some embodiments, the parcel bin may comprise a receiving plate comprising a handle on at least one planar surface of the receiving plate, at least two parcel bin sides, and a delivery plate. A first end of the receiving plate and a first end of the delivery plate may be attached to form an angle between 90 and 110 degrees. Additionally, a catch net configured to receive a parcel that has slid off of the delivery plate may be attached to one of the frame assembly and the delivery plate.

In some embodiments, the frame assembly may be configured to fit inside a support structure. The locking system may comprise a key pad and display monitor that integrally form a handle on an exterior of the parcel receiving apparatus. The locking system may be operable to permit or deny the parcel receiving apparatus from engaging an electric motor that automatically rotates the parcel receiving apparatus into an open position upon successful entry of a personal identification number. Furthermore, the locking system may comprise a timer. The electric motor may be triggered by a sensor system comprising a sensor located on the frame assembly. The sensor may be operable to detect if the parcel receiving apparatus is in the open position. The timer may be operable to trigger the electric motor to automatically close the parcel receiving apparatus after a length of time if the sensor has detected the parcel receiving apparatus to be in the open position for that length of time.

In some embodiments, the parcel receiving apparatus may further comprise a frame assembly comprising an inside housing and an outside housing. The inside housing and the outside housing may be configured to matingly engage each other and rotatably secure the parcel receiving apparatus to the support structure.

In some embodiments, the locking system may be operable to receive a preset personal identification number ("PIN") to permit a user to unlock and open the parcel receiving apparatus. The locking system may be configured to create a plurality of PINs or to maintain a single PIN for all deliveries.

In some embodiments, the parcel receiving apparatus may further comprise pivot bolts configured to allow the parcel bin to rotate on an axis within the frame assembly. The pivot bolts may be threaded at a first segment and smooth at a second segment. The threaded segment may be operable to secure the pivot bolt to the outside housing. Additionally, the smooth segment may be operable to engage low friction bushings in the sides of the parcel receiving bin.

Another embodiment of the invention comprises a parcel receiving apparatus comprising a parcel bin, a frame assembly comprising a microcontroller, a receiver, pivot bolts configured to engage and rotate the parcel bin, at least one electric motor configured to rotate the pivot bolts, and electrical coupling between the microcontroller and the at least one electrical motor. The parcel receiving apparatus may further comprise a locking system. The frame assembly may be configured to fit inside a support structure aperture and circumscribe the parcel bin. The parcel bin may be rotatably attached to the frame assembly along a fixed axis. Additionally, the locking system may be configured to permit or deny rotation of the parcel bin into an open position. The receiver may be configured to receive an access code and transmit that code to the microcontroller. The microcontroller may be configured to compare the access code sent from the receiver with a predefined code stored in memory and to unlock the locking system upon a positively compared code. The microcontroller may signal the electric motor to rotate the pivot bolts and place the parcel receiving apparatus into one of an open position or closed position.

In some embodiments, the microcontroller may be configured to store both an access code and a closing code. The access code may allow the microcontroller to unlock the locking system before signaling the electric motor to rotate the parcel bin to an open position, and the closing code may allow the microcontroller to signal the electric motor to rotate the parcel bin to a closed position before signaling the locking system to lock the parcel receiving apparatus.

In some embodiments, the receiver may be configured to receive one of a radio-frequency identification and a laser identification. Furthermore, the microcontroller may be configured to be electrically connected to the internet.

In some embodiments, an exterior of the frame assembly may comprise a sensor and a security camera both in electrical communication with the microcontroller. In this embodiment the sensor may be configured to detect when the parcel receiving apparatus has begun to open and may signal the security camera to begin recording thereupon.

One embodiment of the parcel receiving apparatus may comprise a parcel bin, a frame assembly comprising a microcontroller, a receiver, pivot bolts configured to engage and rotate the parcel bin, at least one electric motor configured to rotate the pivot bolts, and electrical coupling between the microcontroller and the at least one electrical motor, and a locking system comprising a user interface. The frame assembly may be configured to fit inside a support structure aperture and circumscribe the parcel bin. The parcel bin may be rotatably attached to the frame assembly along a fixed axis and the locking system may be configured to permit or deny rotation of the parcel bin into an exterior open position. The receiver may be configured to receive an access code and transmit that code to the microcontroller that may be configured to compare the access code sent from the receiver with a predefined code stored in memory. The microcontroller may be configured to unlock the locking system upon a positively compared code. The microcontroller may signal the electric motor to rotate the pivot bolts and place the parcel receiving apparatus into one of an open position or closed position. The microcontroller may be configured to be connected to at least one of a local area network (LAN), a personal area network (PAN), a cellular network, or a wide area network (WAN), such as the internet. The microcontroller may be configurable to retain a control access code and a control closing code via one of a user interface and portable electronic device. The parcel receiving apparatus may be configured to be installed into one of a garage door, a building's exterior wall, and a fence.

The embodiment may include the locking system comprising a timer and electric motor triggered by a sensor system comprising a sensor located on the frame assembly. The sensor may detect if the parcel receiving apparatus is in the open position. Furthermore, the timer may trigger the electric motor to automatically close the parcel receiving apparatus after a length of time if the sensor has detected the parcel receiving apparatus to be in the open position for that length of time.

The aforementioned embodiment may also involve the receiver receiving one of a radio-frequency identification and a laser identification from a robotic delivery device. Here, the parcel bin may automatically be rotated to the open position upon authentication of the robotic delivery device. Likewise, the parcel bin may be automatically rotated into the closed position upon one of receipt of a closing code or an elapsed period of time.

DETAILED DESCRIPTION OF THE INVENTION

Figure 1:
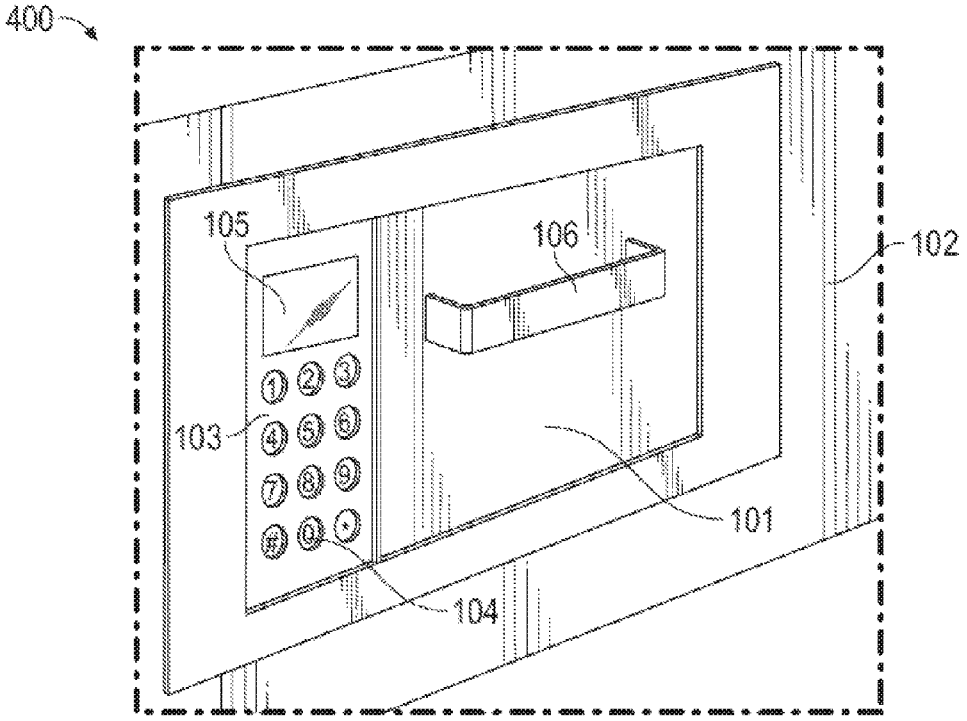
FIG. 1 is a perspective view of an exterior of a parcel receiving apparatus according to an embodiment of the invention.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Those of ordinary skill in the art realize that the following descriptions of the embodiments of the present invention are illustrative and are not intended to be limiting in any way. Other embodiments of the present invention will readily suggest themselves to such skilled persons having the benefit of this disclosure. Like numbers refer to like elements throughout.

Although the following detailed description contains many specifics for the purposes of illustration, anyone of ordinary skill in the art will appreciate that many variations and alterations to the following details are within the scope of the invention. Accordingly, the following embodiments of the invention are set forth without any loss of generality to, and without imposing limitations upon, the claimed invention.

In this detailed description of the present invention, a person skilled in the art should note that directional terms, such as "above," "below," "upper," "lower," and other like terms are used for the convenience of the reader in reference to the drawings. Also, a person skilled in the art should notice this description may contain other terminology to convey position, orientation, and direction without departing from the principles of the present invention.

Furthermore, in this detailed description, a person skilled in the art should note that quantitative qualifying terms such as "generally," "substantially," "mostly," and other terms are used, in general, to mean that the referred to object, characteristic, or quality constitutes a majority of the subject of the reference. The meaning of any of these terms is dependent upon the context within which it is used, and the meaning may be expressly modified.

An embodiment of the invention, as shown and described by the various figures and accompanying text, provides a parcel receiving apparatus with associated methods. While the present embodiment of the parcel receiving apparatus is directed toward metal or metal alloy, any other material capable of providing structured support such as plastic, wood, or graphite is contemplated to be within the scope of the invention.

Some of the illustrative aspects of the present invention may be advantageous in solving the problems herein described and other problems not discussed which are discoverable by a skilled artisan.

Referring now to FIGS. 1-5, a parcel receiving apparatus 400 will now be discussed. The exterior of the parcel receiving apparatus 400 may include an outside frame that circumscribes a parcel bin 300. When in the closed position, the parcel bin exterior front 101 may be aligned and be parallel to a supporting structure 102 within which the parcel receiving apparatus 400 may be installed and carried by. The parcel bin exterior front 101 may include a locking system 103 that may comprise a user interface, that in the present embodiment comprises a key pad 104 and display monitor 105. The locking system 103 may be configured to electronically allow or deny open access to the parcel bin 300 by permitting or denying rotation of the parcel bin 300. More specifically, the locking system 103 may be configured to prompt a user via the display monitor 105 to input a code, which the user may enter using the key pad 104. The locking system 103 may further indicate whether the code entered by the user was accepted or rejected via the display monitor 105. If the user enters an accepted code, the locking system 103 may allow access to the parcel bin 300.

Figure 6:
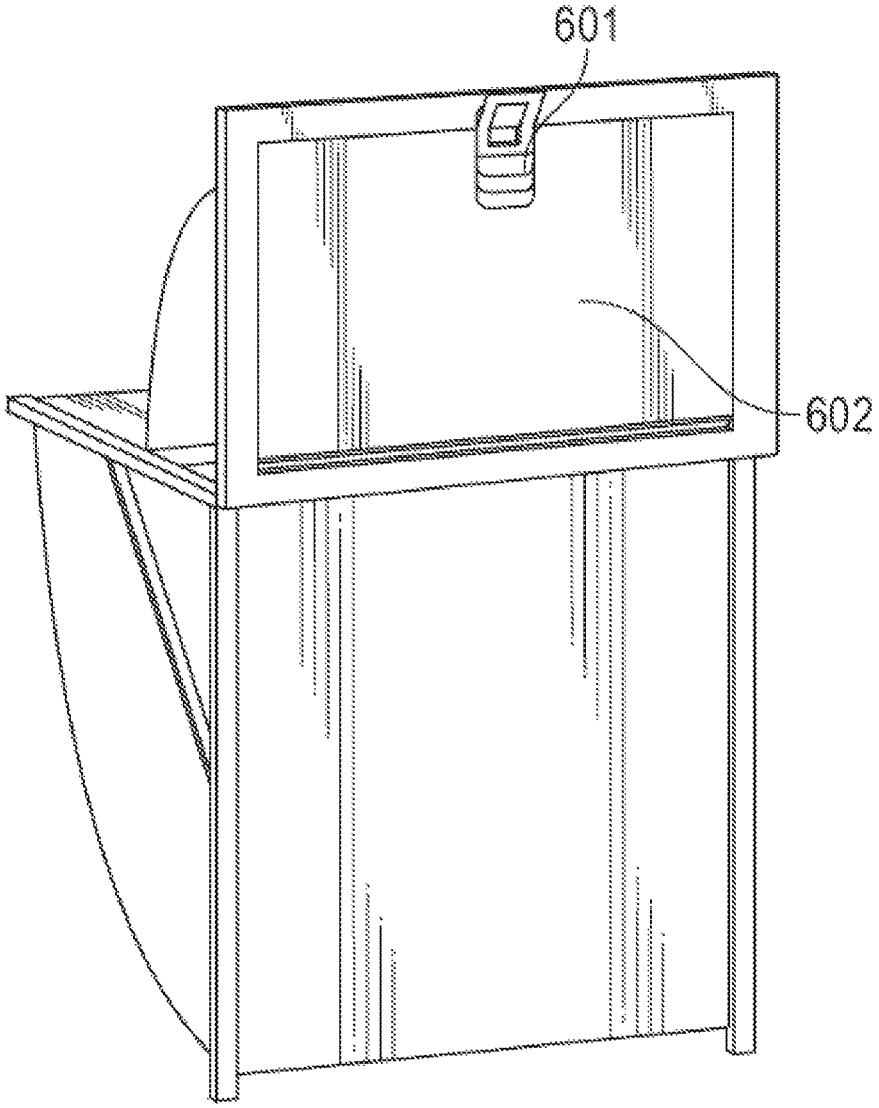
FIG. 6 is a perspective view of the exterior of the parcel receiving apparatus of FIG. 1 with a parcel bin in the closed position.

Additionally, the parcel bin exterior front 101 may include a handle 106 configured to facilitate a user's ability to open and close the parcel bin 300 from the outside once access has been allowed. In an alternate embodiment, the key pad 104 and display monitor 105 may be integrally formed with the handle on the exterior of the parcel receiving apparatus 400 as shown in FIG. 6, which will be discussed in greater detail hereinbelow. Additionally, the parcel bin exterior front 101 may include an attachable aesthetic panel to match the color of the supporting structure 102.

Figure 2:
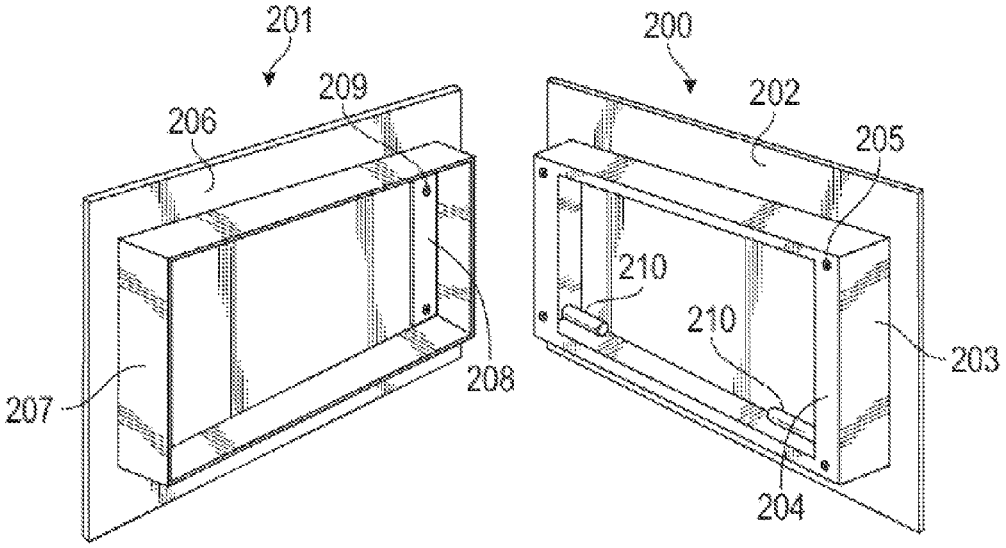
FIG. 2 is a perspective view of a disassembled frame assembly of the parcel receiving apparatus of FIG. 1.

Referring now specifically to FIG. 2, the parcel receiving apparatus 400 may comprise a parcel frame assembly 200 configured to secure the parcel receiving apparatus 400 to a supporting structure 102 while carrying the parcel bin 300. The frame assembly 200 may comprise an exterior frame structure 200 and an interior frame structure 201 configured to matingly engage each other through an appropriately sized aperture in the supporting structure 102. The exterior frame structure 200 may comprise an outside frame 202 that circumscribes an outside housing 203. The outside housing 203 may include an edge defined as an outside frame holding member 204 that contains outside screw holes 205 therein. The interior frame structure 201 may comprise an inside frame 206 that circumscribes an inside housing 207. Attached to the interior of the inside housing 207 is an inside frame holding member 208 that contains inside screw holes 209. The interior frame structure 201 and exterior frame structure 200 may be fitted together through an aperture in the supporting structure 102 and secured to each other by means of screws configured to fit through the inside screw holes 209 and the outside screw holes 205. Each of the interior frame structure 201 and the exterior frame structure 200 may have a geometric configuration that facilitates attachment therebetween, and that may further cooperate with the aperture of the supporting structure 102.

Figure 3:
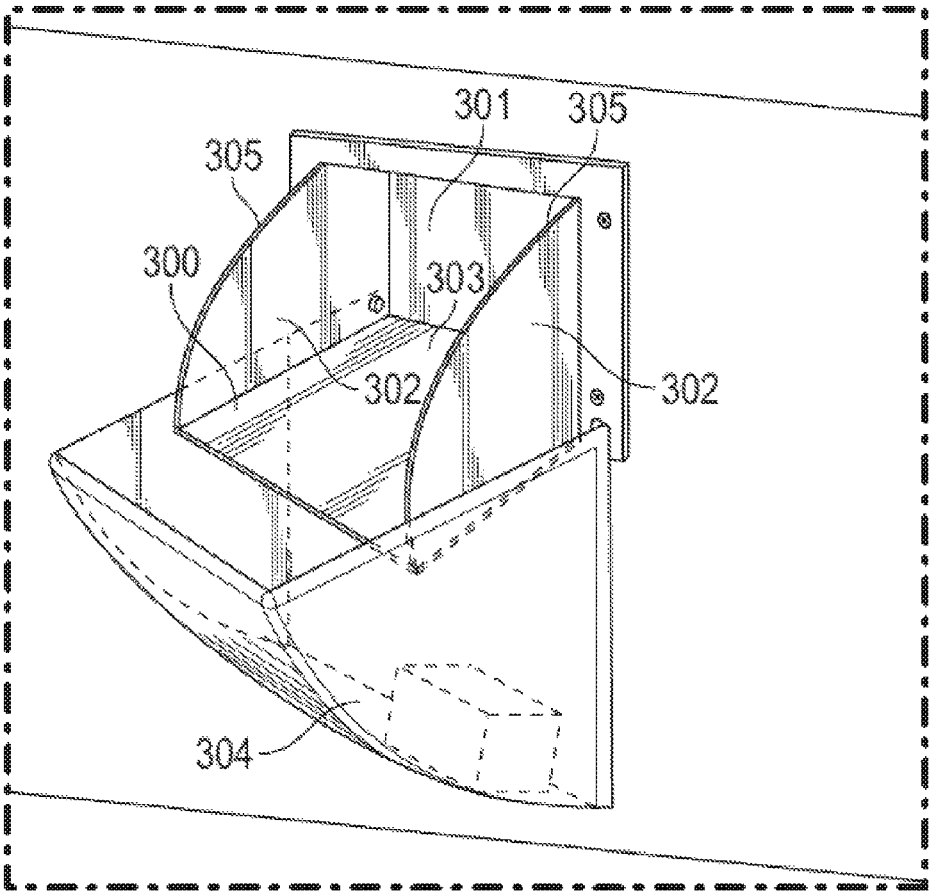
FIG. 3 is a perspective view of the interior components of the parcel receiving apparatus of FIG. 1.
Figure 4:
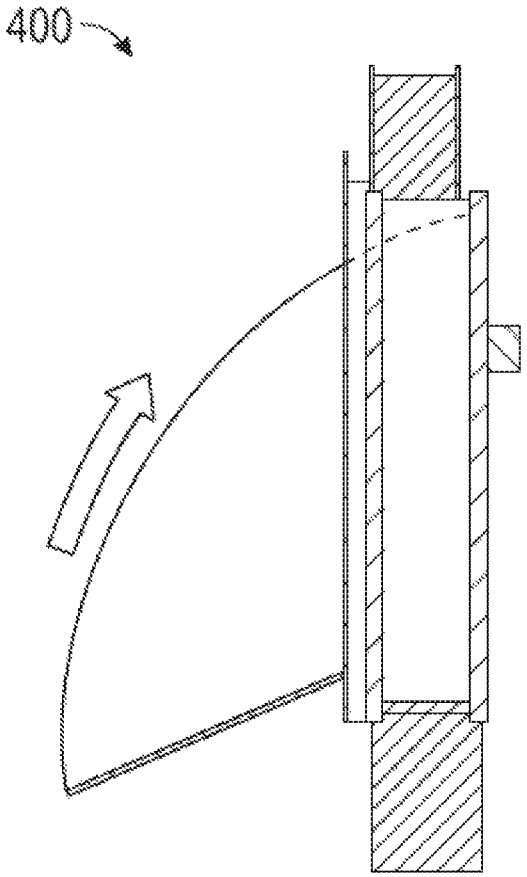
FIG. 4 is a side plan view of the parcel receiving apparatus of FIG. 1.

When fitted together, the inside housing 207 and the outside housing 203 may carry the parcel bin 300. Referring now additionally to FIG. 3, additional aspects regarding the parcel bin 300 will be discussed. The parcel bin 300 may be rotatably attached to the outside housing by pivot bolts 210. The pivot bolts 210 are threaded at a first segment and smooth at a second segment. The threaded segment is used to secure the pivot bolt 210 to the outside housing while the smooth segment is used to engage low friction bushings in the sides of the parcel bin 300. The pivot bolts 210 are configured to allow the parcel bin 300 to rotate about their smooth segments.

Figure 5:
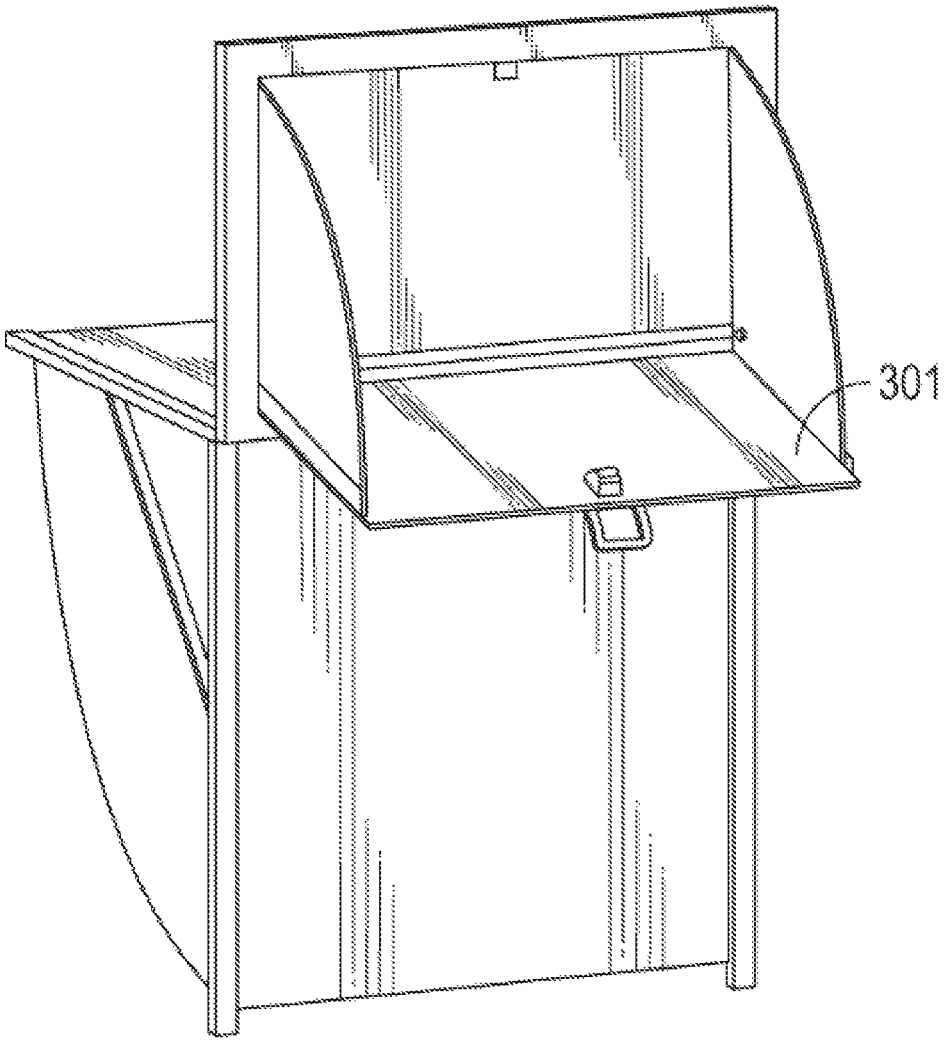
FIG. 5 is a perspective view of the exterior of the parcel receiving apparatus of FIG. 1 with a parcel bin in the open position.

The parcel bin 300 may include a flat receiving plate 301, parcel bin sides 302, and a sloped delivery plate 303. A first end of the flat receiving plate 301 and a first end of the sloped delivery plate 303 may be connected and may form an angle between 90 and 110 degrees in relation to each other. As shown in FIG. 5, when the parcel bin 300 is in a fully opened position from the exterior, the flat receiving plate 301 forms substantially a 90 degree angle with the supporting structure 102 and runs substantially parallel to the ground. This facilitates the placement of a delivered parcel thereon. When the parcel bin 300 is in the closed position from the outside, it is in an open position from the inside as demonstrated in FIG. 3 and FIG. 4. When the parcel bin 300 is in the open position from the inside, the sloped delivery plate 303 forms less than a 90 degree angle with the supporting structure 102 in order to facilitate a parcel sliding off of the sloped delivery plate 303 and into a flexible catch net 304 attached underneath or onto the ground. One of the parcel bin sides 302 is connected to a second end of the sloped delivery plate 303 and a second end of the flat receiving plate 301. Another parcel bin side 302 is connected to a third end of the sloped delivery plate 303 and a third end of the flat receiving plate 301. The parcel bin side edges 305 of the parcel bin sides 302 may be convex in shape in order to facilitate the movement of the parcel bin 300 between open and shut positions.

A method of using the parcel receiving apparatus 400 described in FIGS. 1-6 will now be discussed. The parcel receiving apparatus 400 will ideally be installed in a garage door, an exterior wall of a home or other building, or a fence. The locking system 103 will be secured by the owner of the parcel receiving apparatus 400 by way of a personal identification number ("PIN") chosen by the owner. A delivery person wishing to deliver a parcel to a specified address with a parcel receiving apparatus 400 would be given the PIN in advance as a part of the delivery instructions. The locking system 103 may be configured in a manner so that the owner can change the PIN after a single delivery, maintain the same PIN for all deliveries, or may be configured to create subsets of PINs for specific deliveries. The delivery person may type in the preset PIN in order to unlock the parcel receiving apparatus 400 from the outside. The delivery person may then use a handle or other means to open the parcel receiving apparatus 400 thereby placing the flat receiving plate substantially perpendicular to the ground as shown in FIG. 5. The delivery person then may place a parcel on the flat receiving plate 301 and return the parcel receiving apparatus 400 to its outside closed and locked position as shown in FIG. 6. As a result of returning the parcel receiving apparatus 400 to its outside closed and locked position, the parcel receiving apparatus 400 is placed into an inside open position as shown in FIG. 3. Furthermore, the parcel itself is transferred from the flat receiving plate 301 to the sloped delivery plate 303 in the process. The downward slope of the sloped delivery plate 303 allows the parcel to slide off of the sloped delivery plate 303 and into a flexible catch net 304 or onto the inside floor. One skilled in the art may recognize that a variety of catch net 304 devices may be utilized to carry out the functionality of holding the parcel. These devices may include a basket and a rolling thermal bin with a spring loaded lid for receiving cold deliveries.

Figure 7:
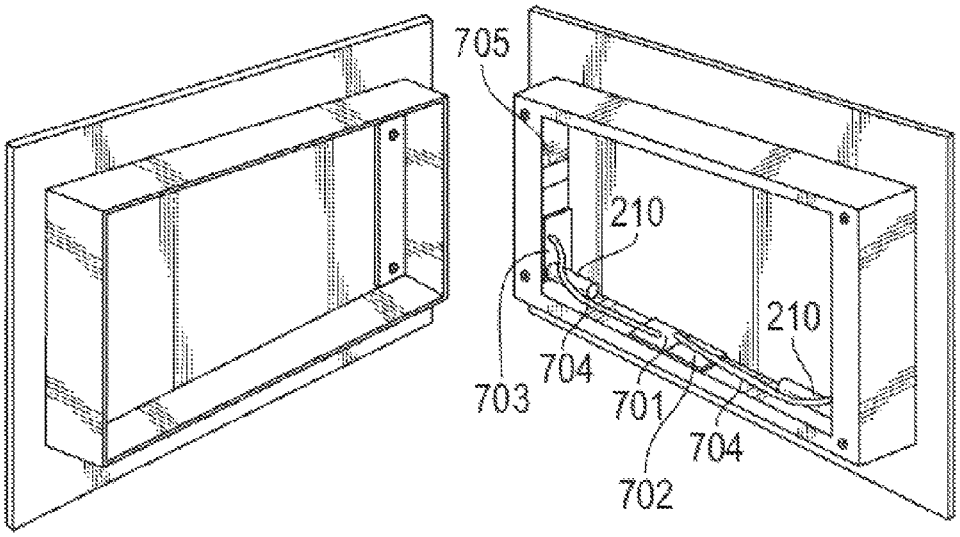
FIG. 7 is a perspective view of additional interior components according to an alternative embodiment of FIG. 3

Referring now to FIG. 7, another embodiment of the parcel receiving apparatus 400 may have the parcel frame assembly 200 further include a microcontroller 701, a receiver 702, at least one electrical motor 703, and electrical coupling between the microcontroller 701 and the at least one electrical motor 703. In this embodiment the receiver 702 may be configured to receive an access code and transmit that code to the microcontroller 701. The microcontroller 701 may then compare the access code sent from the receiver 702 to a predefined code stored in memory of the microcontroller 701. If the access code sent from the receiver 702 matches the access code stored in the microcontroller 701 memory, then the microcontroller 701 may unlock the locking system 103 and signal the electric motor 703 to rotate the pivot bolts 210 thereby placing the parcel receiving apparatus 400 into an open position. For purposes of the remainder of this application, open and closed position shall refer to the orientation of the parcel bin 300 as viewed from the outside of a structure as depicted in FIG. 1. Furthermore, the microcontroller 701 may be configured to receive a code from the receiver 702, defined as a closing code, compare that closing code to a predefined closing code stored in memory and place the parcel receiving apparatus 400 into a closed position. When returned to a closed position the microcontroller 701 may signal the locking system 103 to once again lock the parcel receiving apparatus 400.

The receiver 702 may be operable to receive a wireless transmission from a remote device, such as one possessed by the user or one possessed by a robotic delivery device like a drone. The wireless transmission may be an electromagnetic transmission, for instance, a LASER transmission within at least one of the IR, visible, and ultraviolet spectra, and a radio frequency transmission. The transmission may include an identification code, resulting in the received transmission being at least one of a laser identification and a radio-frequency identification.

The code to open and close the parcel receiving apparatus may be the same or may be different. A person skilled in the art will appreciate that the microcontroller 701 memory may store a multitude of codes that, upon positive comparison from a received code from the receiver 702, may place the parcel receiving apparatus 400 into either an open or closed position.

In some embodiments, the microcontroller 701 may be operable to communicate across a network, such as a local area network (LAN), a personal area network (PAN), a cellular network, or a wide area network (WAN), such as the internet. Such communication may be accomplished using any wired or wireless communication standard as is known in the art, including, but not limited to, Ethernet, universal serial bus (USB), 802.11/WiFI, Bluetooth, Zigbee/Z-Wave, code division multiple access (CDMA), time division multiple access (TDMA), Global System for Mobile Communications (GSM), Long-Term Evolution (LTE), WiMAX, 5G mobile networks, and the like. Moreover, the microcontroller 701 may be operable to transmit information related to the parcel receiving apparatus 400 across the network to a remote computerized device, such as a personal computer, a mobile phone, a tablet computer, a server, and the like. Furthermore, the microcontroller 701 may be operable to receive transmissions from a remote computerized device, such as an online mobile device, and be configured by the received transmissions to affect the operation of the parcel receiving apparatus 400.

In some embodiments, the locking system 103 may comprise a timer (not shown) operable to provide an indication of the time of day or to provide a measured period of time to elapse before signaling the microcontroller 701 to open or close the parcel bin 300. Additionally, the parcel receiving apparatus 400 may comprise a sensor system comprising a sensor 705. The sensor may be operable to detect a status of the parcel receiving apparatus 400, such as, but not limited to, open and closed, with an open state being understood as the parcel bin 300 being ajar from the exterior. The sensor 705 may be any type of sensor as is known in the art, including, but not limited to, pressure sensors, optical sensors, magnetic sensors, and the like. Each of the timer and the sensor 705 may be positioned in electrical communication with the microcontroller 701. The microcontroller 701 may determine a length of time the parcel receiving apparatus 400 has been in an open or closed position based on signals received from each of the timer and the sensor 705. Furthermore, the microcontroller 701 may be operable to, upon determining the parcel receiving apparatus 400 has been in an open position for a threshold length of time, activate the electric motor 703 to close the parcel receiving apparatus 400.

In one operational embodiment, an identification as described hereinabove may be received from a robotic delivery device. The parcel bin 300 may then automatically be rotated to the open position upon authentication of the identification received from the robotic delivery device. The parcel bin 300 may then be automatically rotated into the closed position upon one of receipt of a closing code or an elapsed period of time.

Furthermore, the microcontroller 701 may be operable to communicate with the display monitor 105 to provide information regarding the status of the parcel receiving apparatus 400 (i.e. it may be opened, is currently open/ajar, is currently closed/locked) or a countdown regarding the time before the parcel receiving apparatus 400 will be closed.

Additionally, the microcontroller 701 may be positioned in communication with a security camera (not shown) that is positioned such that the parcel receiving apparatus 400 is within a field of view of the security camera. In some embodiments, the security camera may be positioned on the exterior frame structure 200. The microcontroller 701 may be operable to, upon receiving a signal from the sensor 705 that the parcel receiving apparatus 400 is open, transmit a signal to the security camera to begin a video recording and send a video feed to at least one of the microcontroller 701 and a remote computerized device. This video feed may thereby capture a parcel being delivered.

While the above description contains much specificity, these should not be construed as limitations on the scope of any embodiment, but as exemplifications of the presented embodiments thereof. Many other ramifications and variations are possible within the teachings of the various embodiments. While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the scope of the appended claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

Thus the scope of the invention should be determined by the appended claims and their legal equivalents, and not by the examples given.

That which is claimed is:

1. A parcel receiving apparatus comprising:

a parcel bin;

a frame assembly; and a locking system;

wherein the frame assembly is configured to fit inside a support structure aperture and circumscribe the parcel bin;

wherein the parcel bin is rotatably attached to the frame assembly along a fixed axis;

wherein the locking system is operable to permit or deny a user from rotating the parcel bin into an open position;

wherein pivot bolts are configured to allow the parcel bin to rotate within the frame assembly;

wherein the pivot bolts are threaded at a first segment and smooth at a second segment;

wherein the threaded segment is operable to secure the pivot bolt to the outside housing; and wherein the smooth segment is operable to engage low friction bushings in the sides of the parcel receiving bin.

2. The parcel receiving apparatus of claim 1 wherein the parcel bin comprises:

a receiving plate comprising a handle on at least one planar surface of the receiving plate;

at least two parcel bin sides; and a delivery plate;

wherein a first end of the receiving plate and a first end of the delivery plate are attached to form an angle between 90 and 110 degrees.

3. The parcel receiving apparatus of claim 2 wherein a catch net is configured to receive a parcel that has slid off of the delivery plate is attached to one of the frame assembly and the delivery plate.

4. The parcel receiving apparatus of claim 1 wherein the frame assembly is configured to fit inside a support structure.

5. The parcel receiving apparatus of claim 1 wherein the locking system comprises a key pad, a display monitor, and a handle on an exterior front of the parcel bin.

6. The parcel receiving apparatus of claim 1 wherein the locking system is operable to permit or deny the parcel receiving apparatus from engaging an electric motor that automatically rotates the parcel receiving apparatus into an exterior open position upon successful entry of a personal identification number.

7. The parcel receiving apparatus of claim 6 wherein the locking system comprises a timer; wherein the electric motor is triggered by a sensor system comprising a sensor located on the frame assembly; wherein the sensor is operable to detect if the parcel receiving apparatus is in the open position; and wherein the timer triggers the electric motor to automatically close the parcel receiving apparatus after a length of time if the sensor has detected the parcel receiving apparatus to be in the open position for a time equal to or exceeding that length of time.

8. The parcel receiving apparatus of claim 1 further including a frame assembly comprising:

an inside housing; and an outside housing;

wherein the inside housing and the outside housing are configured to matingly engage each other and rotatably secure the parcel receiving apparatus to the support structure.

9. The parcel receiving apparatus of claim 1 wherein the locking system is operable to receive a preset personal identification number ("PIN") to permit a user to unlock and open the parcel receiving apparatus.

10. The parcel receiving apparatus of claim 9 wherein the locking system is configured to create a plurality of PINs.

11. The parcel receiving apparatus of claim 9 wherein the locking system is configured to maintain a single PIN for all deliveries.

12. A parcel receiving apparatus comprising:

a parcel bin;

a frame assembly comprising a microcontroller, a receiver, pivot bolts configured to engage and rotate the parcel bin, at least one electric motor configured to rotate the pivot bolts, and electrical coupling between the microcontroller and the at least one electrical motor; and a locking system;

wherein the frame assembly is configured to fit inside a support structure aperture and circumscribe the parcel bin;

wherein the parcel bin is rotatably attached to the frame assembly along a fixed axis;

wherein the locking system is configured to permit or deny rotation of the parcel bin into an open position;

wherein the receiver is configured to receive an access code and transmit that code to the microcontroller;

wherein the microcontroller is configured to compare the access code sent from the receiver with a predefined code stored in memory;

wherein the microcontroller is configured to unlock the locking system upon a positively compared code;

wherein the microcontroller signals the electric motor to rotate the pivot bolts and place the parcel receiving apparatus into one of an open position or closed position.

13. The parcel receiving apparatus of claim 12 wherein the microcontroller is configured to store both an access code and a closing code; wherein the access code allows the microcontroller to unlock the locking system before signaling the electric motor to rotate the parcel bin to an open position; and wherein the closing code allows the microcontroller to signal the electric motor to rotate the parcel bin to a closed position before signaling the locking system to lock the parcel receiving apparatus.

14. The parcel receiving apparatus of claim 12 wherein the receiver is configured to receive at least one of a radio-frequency identification and a laser identification.

15. The parcel receiving apparatus of claim 12 wherein the microcontroller is configured to be connected to the internet.

16. The parcel receiving apparatus of claim 12 wherein an exterior of the frame assembly comprises a sensor and a security camera both in electrical communication with the microcontroller; and wherein the sensor is configured to detect when the parcel receiving apparatus has begun to open and signals the security camera to begin recording thereupon.

17. A parcel receiving apparatus comprising:

a parcel bin;

a frame assembly comprising a microcontroller, a receiver, pivot bolts configured to engage and rotate the parcel bin, at least one electric motor configured to rotate the pivot bolts, and electrical coupling between the microcontroller and the at least one electrical motor; and a locking system comprising a user interface;

wherein the frame assembly is configured to fit inside a support structure aperture and circumscribe the parcel bin;

wherein the parcel bin is rotatably attached to the frame assembly along a fixed axis;

wherein the locking system is configured to permit or deny rotation of the parcel bin into an open position;

wherein the receiver is configured to receive an access code and transmit that code to the microcontroller;

wherein the microcontroller is configured to compare the access code sent from the receiver with a predefined code stored in memory;

wherein the microcontroller is configured to unlock the locking system upon a positively compared code;

wherein the microcontroller signals the electric motor to rotate the pivot bolts and place the parcel receiving apparatus into one of an open position or closed position;

wherein the microcontroller is configured to be connected to at least one of a local area network (LAN), a personal area network (PAN), a cellular network, or a wide area network (WAN), such as the internet;

wherein the microcontroller is configurable to retain a control access code and a control closing code via one of a user interface and portable electronic device; and wherein the parcel receiving apparatus is configured to be installed into one of a garage door, a building's exterior wall, and a fence.

18. The parcel receiving apparatus of claim 17 wherein the locking system comprises a timer and the electric motor is triggered by a sensor system comprising a sensor located on the frame assembly; wherein the sensor detects if the parcel receiving apparatus is in the open position; wherein the timer triggers the electric motor to automatically close the parcel receiving apparatus after a length of time if the sensor has detected the parcel receiving apparatus to be in the open position for that length of time.

19. The parcel receiving apparatus of claim 17 wherein the receiver receives one of a radio-frequency identification and a laser identification from a robotic delivery device; wherein the parcel bin is automatically rotated to the open position upon authentication of the robotic delivery device; wherein the parcel bin is automatically rotated into the closed position upon one of receipt of a closing code or an elapsed period of time.

* * * * *